United States Patent [19]

Gartner

[11] Patent Number: 4,569,170

[45] Date of Patent: Feb. 11, 1986

[54] JOINT STRUCTURE FOR TWO ADJACENT THERMALLY-INSULATED WINDOW UNITS

[75] Inventor: Karl Gartner, Gundelfingen, Fed. Rep. of Germany

[73] Assignee: Yoshida Kogyo K.K., Tokyo, Japan

[21] Appl. No.: 516,205

[22] Filed: Jul. 22, 1983

[30] Foreign Application Priority Data

Jul. 27, 1982 [JP] Japan ..... 57-113504

[51] Int. Cl.[4] ..... E04C 1/00

[52] U.S. Cl. ..... 52/204; 52/235; 52/589; 52/593; 49/DIG. 1

[58] Field of Search ..... 52/204, 578, 582, 593, 52/589, 588, 573, 595, 475, 452, 458, 235, 206, 393, 395, 403; 49/DIG. 2, 483

[56] References Cited

U.S. PATENT DOCUMENTS 3,071,215 1/1963 Gall ..... 52/235 X
3,367,076 2/1968 O'Brien ..... 52/593 X
4,471,584 9/1984 Dietrich ..... 52/235 X

FOREIGN PATENT DOCUMENTS 3115573 12/1982 Fed. Rep. of Germany ..... 52/204
2060750 5/1981 United Kingdom ..... 49/DIG. 1

*Primary Examiner*—Carl D. Friedman
*Assistant Examiner*—Creighton Smith
*Attorney, Agent, or Firm*—Hill, Van Santen, Steadman & Simpson

[57] ABSTRACT

A joint structure for two juxtaposed thermally-insulated window units, includes cooperating pairs of plug and socket members disposed on and along opposite inner edges of the window units. The plug members are resiliently received in the mating socket members and are movable with respect to the same to thereby take up or accommodate a relative displacement between the window units, thermal deformation and manufacturing tolerances created in the window units. A resilient block of thermal insulating material is disposed in a space between the opposite inner edges so as to increase the mechanical strength and the thermal insulation of the joint between the window units.

8 Claims, 3 Drawing Figures

JOINT STRUCTURE FOR TWO ADJACENT THERMALLY-INSULATED WINDOW UNITS

BACKGROUND OF THE INVENTION

1. Field of the Invention

The present invention relates to a joint structure for adjacent two thermally-insulated window units adapted to be mounted in a building opening.

2. Prior Art

Various joint structures of the type described have been proposed. Although, in general, the proposed joint structures have performed satisfactorily, they have not been found to be entirely suitable in applications wherein substantial accomodation for a manufacturing tolerance in, and a relative displacement between, adjacent window units is a major requirement.

SUMMARY OF THE INVENTION

It is therefore an object of the present invention to provide a joint structure for two adjacent thermally-insulated window units wherein a relative displacement between the window units, thermal deformation and manufacturing tolerances created in the window units can be taken out or accomodated by the joint structure.

Another object of the present invention is to provide such a joint structure having an increased degree of mechanical strength and thermal insulation.

According to the present invention, a joint structure for two juxtaposed thermally-insulated window units includes cooperating pairs of plug and socket members disposed on and along opposite inner edges of the window units. The plug members are resiliently received in the mating socket members and are movable with respect to the same to thereby take up or accomodate a relative displacement between the window units, thermal deformation and manufacturing tolerances in the window units. A resilient block of thermal insulating material is disposed in a space between the opposite inner edges so as to increase the mechanical strength and the thermal insulation of the joint between the window units.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE INVENTION

DETAILED DESCRIPTION

Figure 1:
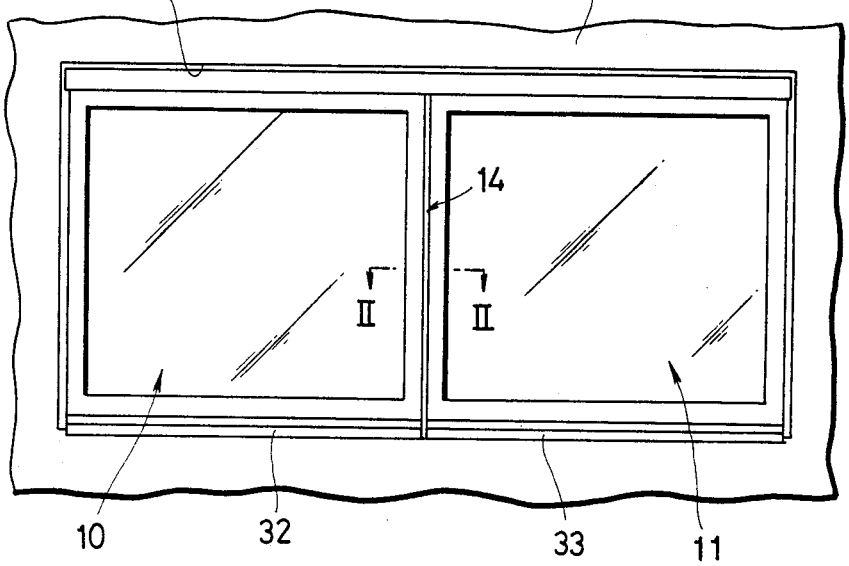
FIG. 1 is a schematic front elevational view of a pair of window units including a joint structure according to the present invention.

As shown in FIG. 1, a pair of thermally-insulated window units 10, 11 is mounted within a rectangular opening 12 provided in a building wall 13. The window units 10, 11 are connected together in juxtaposition at a joint 14 therebetween.

Figure 2:
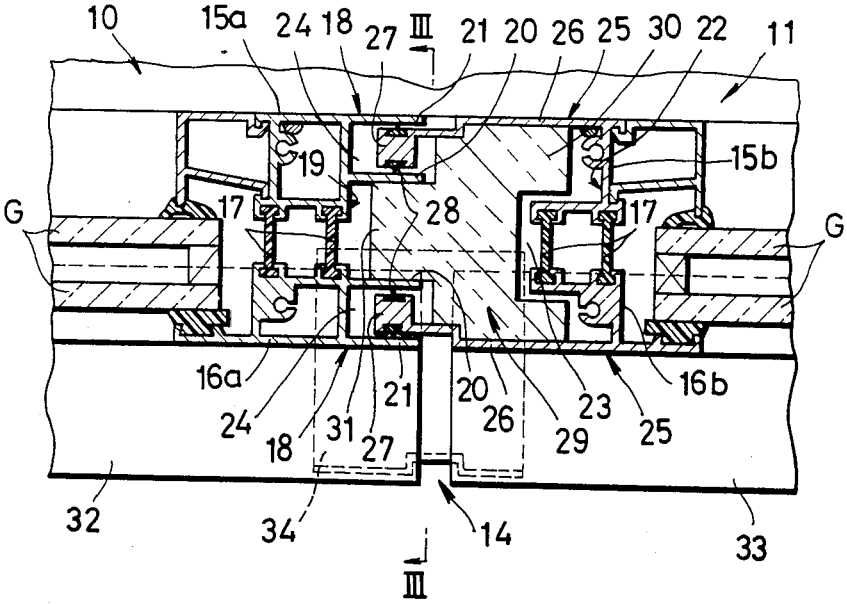
FIG. 2 is an enlarged cross-sectional view taken along line II—II of FIG. 1.

As shown in FIG. 2, each of the window units 10, 11 includes a pair of spaced interior and exterior frame members 15*a*, 15*b* and 16*a*, 16*b* interconnected by a plurality (two being shown) of connectors 17 of thermal insulating material. The frame members 15*a*, 15*b*, 16*a*, 16*b*, are made of metal such as extruded aluminum. A pair of spaced glass panes G is mounted on each window unit 10, 11 substantially centrally between the interior and exterior frame members 15*a*, 16*a*, or 15*b*, 16*b*.

The window unit 10 includes a pair of socket members 18, disposed respectively on the interior and exterior frame members 15*a*, 16*a* along an inner edge 19 of the window unit 10. Each of the socket members 18 has a pair of parallel spaced inner and outer fins 20, 21 integral with the interior or exterior frame member 15*a* or 16*a* and projecting therefrom toward an inner edge 22 of the other window unit 11. The inner edges 19, 22 confront each other with a space 23 therebetween. An elongate channel 24 lies between each pair of the fins 20, 21 and communicates with the space 23.

The window unit 11 includes a pair of plug members 25, disposed respectively on the interior and exterior frame members 15*b*, 16*b* along the inner edge 22. Each of the plug members 25 includes a leg 26 integral with the interior or exterior frame member 15*b*, or 16*b* and projecting therefrom toward corresponding one of the socket members 18. The leg 26 has at its free end an enlarged foot 27 of substantially rectangular cross section loosely received in the channel 24 in each socket member 18. A pair of resilient weather strips 28 is mounted one on each side of each foot 27 and is held in sealing contact with the inner and outer fins 20, 21 of each socket member 18.

A resilient block 29 of rigid thermal insulating material such as glass wool, rock wool, foamed rigid polystyrene or the like is compressedly disposed in the space 23 between the opposite inner edges 19, 22 of the window units 10, 11 so as to provide for the joint 14 with an increased degree of mechanical strength and thermal insulation. The block 29 has a generally Y-shaped cross section including a bifurcated head 30 sandwiched between the legs 26 and a body 31 sandwiched between the opposite inner fins 20.

The block 29 may be bonded by an adhesive either to the legs 26 or to the fins 20, at the head 30 or the body 31 so as to further strengthen the joint 14 without hindering the relative movement of the window units 10, 11. Alternatively, the block 29 may be formed of a foamed rigid plastic filled in the space 23 by a foaming-in place method.

Figure 3:
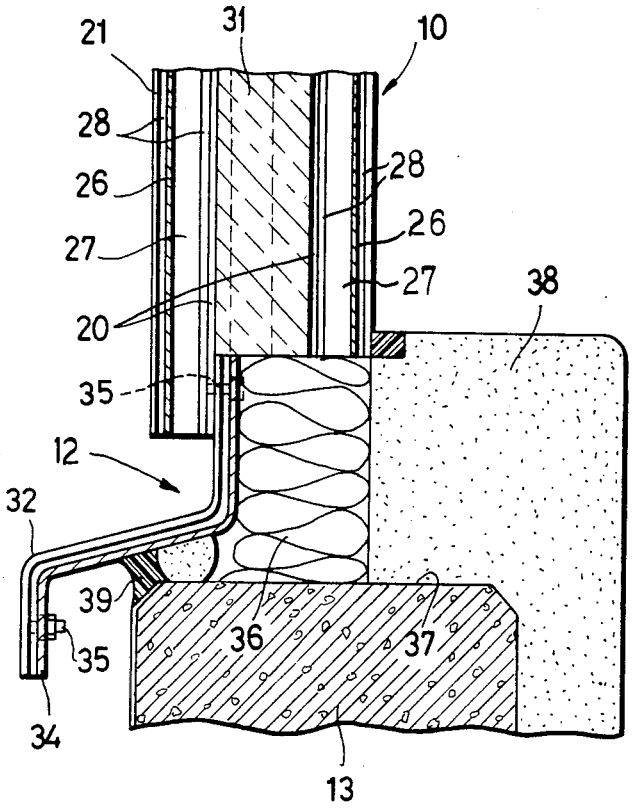
FIG. 3 is a cross-sectional view taken along line III—III of FIG. 2.

As shown in FIGS. 2 and 3, a pair of flashings 32, 33 is secured at respective upper ends to the bottom portion of the interior frame members 15*a*, 15*b* of the respective window units 10, 11. The window units 10, 11 are interconnected by a connector plate 34 extending over the joint 14 between the window units 10, 11, the connector plate 34 being complementary in cross section to the flashings 32, 33 and disposed behind the flashings 32, 33. The flashings 32, 33 are secured to the connector plate 34 by stud bolts 35 (FIG. 3).

FIG. 3 shows the window unit 10 as mounted within the opening 12. A thermal insulating material 36 such as glass wool is placed in a space between the bottom of the window unit 10 and an edge 37 defining the bottom portion of the opening 12. The interior sides of the bottom of the window unit 10 and the building wall 13 are covered with an interior siding 38. A space between the connector plate 34 and the edge 37 is sealed by a suitable caulking material 39.

The joint structure thus arranged substantially takes up or accomodates for manufacturing tolerances created in the window units in installation of the same, a relative displacement of the window units under severe vibratory stresses, and a thermal deformation of the window units. The resilient thermal insulating block filled in the space in the joint substantially increases thermal insulation of the joint.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. In a window construction including a pair of thermally-insulated window units having edges disposed in confronting edge-to-edge relationship with a space defined there between, each window unit having a pair of spaced interior and exterior frame members interconnected by bridging connectors of thermal insulating material, the improvement of a joint structure between said window units, comprising:

(a) a first pair of plug and socket members disposed respectively on said interior frame members and extending along their confronting edges;

(b) a second pair of plug and socket members disposed respectively on confronting edges of said exterior frame members, each said plug member of both pairs being resiliently received in and mating with one of said socket members and displaceable with respect to the same; and (c) a resilient block of thermal insulating material disposed in said space between said confronting edges of both pairs of said frame members and engaging a portion of said pairs of plug and socket members.

2. A joint structure for a pair of thermally-insulated window units having opposite inner edges disposed in juxtaposition with a space defined between their opposite inner edges, each window unit having a pair of spaced interior and exterior frame members interconnected by connectors of thermal insulating material, said joint structure comprising:

(a) a first pair of plug and socket members disposed respectively on the interior members along the opposite inner edges;

(b) a second pair of plug and socket members disposed respectively on the exterior members, each said plug member being resiliently received in and mating with one of said socket members and displaceable with respect to the same;

(c) a resilient block of thermal insulating material disposed in the space between the opposite inner edges of the window units; and (d) both said plug members being disposed respectively on the interior and exterior frame members of one of the window units.

3. A window construction according to claim 1, each said socket member including a pair of parallel spaced fins respectively projecting from one of said interior or exterior frame members, and each said plug member including a leg projecting from the other interior or exterior frame member towards said one interior or exterior frame member, and having at its free end an enlarged foot, and a pair of resilient strips on opposite sides of said foot, said resilient strips being held in sealing contact with said fins of the corresponding one of said socket members.

4. A window construction according to claim 1, said resilient, thermal insulating block being bonded to one of said plug and socket members.

5. A window construction according to claim 1, said resilient thermal insulating block being made of glass wool.

6. A window construction according to claim 1, said resilient thermal insulating block being of a type of rigid plastic foamed in said space.

7. A window construction according to claim 1, said resilient thermal insulating block being made of rock wool.

8. A window construction according to claim 1, said resilient thermal insulating block being made of foamed rigid polystyrene.

* * * * *